United States Patent [19]

Kanocz

[11] 4,119,289

[45] Oct. 10, 1978

[54] COLLAPSIBLE READING STAND

[75] Inventor: Julianna Kanocz, Holliswood, N.Y.

[73] Assignee: The Raymond Lee Organization, Inc., New York, N.Y. ; a part interest

[21] Appl. No.: 869,996

[22] Filed: Jan. 16, 1978

[51] Int. Cl.[2] ..... A47G 1/24

[52] U.S. Cl. ..... 248/454; 248/166; 248/460

[58] Field of Search ..... 248/150, 165, 166, 172, 248/451, 454, 455, 456, 457, 460, 464, 453

[56] References Cited

U.S. PATENT DOCUMENTS

| | | | |
|---|---|---|---|
| 733,100 | 7/1903 | Werner | 248/456 |
| 763,382 | 6/1904 | Entler | 248/456 |
| 1,938,638 | 12/1933 | Ponten et al. | 248/457 |
| 2,739,776 | 3/1956 | Terando | 248/172 X |
| 3,215,382 | 11/1965 | Stein | 248/172 |
| 3,813,074 | 5/1974 | Mulvaney | 248/464 X |
| 3,899,164 | 8/1975 | Newman | 248/451 X |

*Primary Examiner*—William H. Schultz
*Attorney, Agent, or Firm*—Daniel Jay Tick

[57] ABSTRACT

A collapsible reading stand consists of a plurality of upright stick-like support members and a plurality of strut members pivotally affixed to each other in a manner whereby they are collapsible relative to each other and extendable to form a stand for supporting a book-supporting member. The book-supporting member is positionable in selected grooves formed in the support members for supporting a book at a desired inclination.

1 Claim, 5 Drawing Figures

FIG. 1
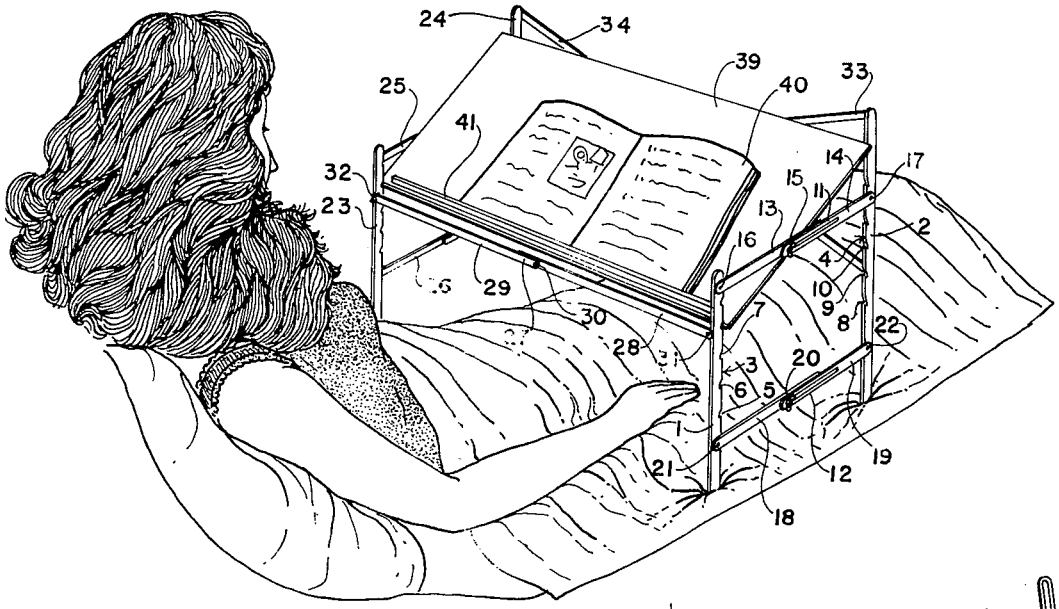
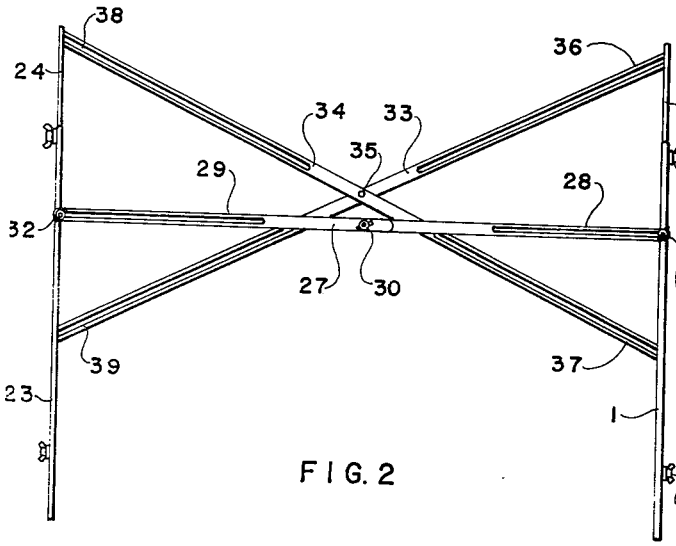
FIG. 2
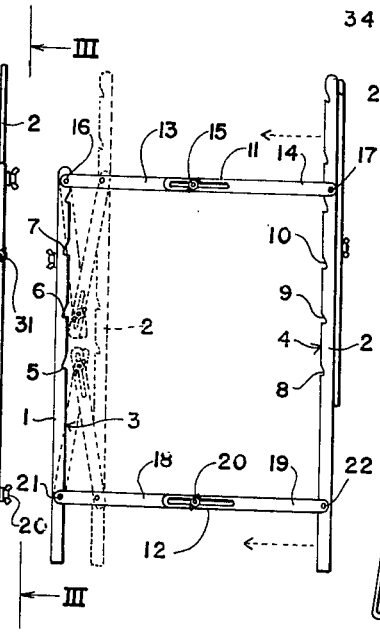
FIG. 3
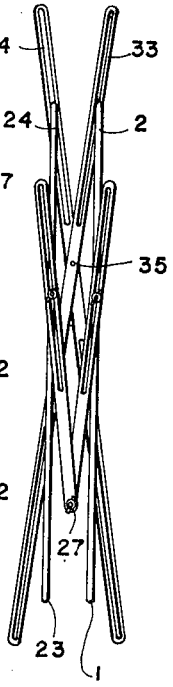
FIG. 4
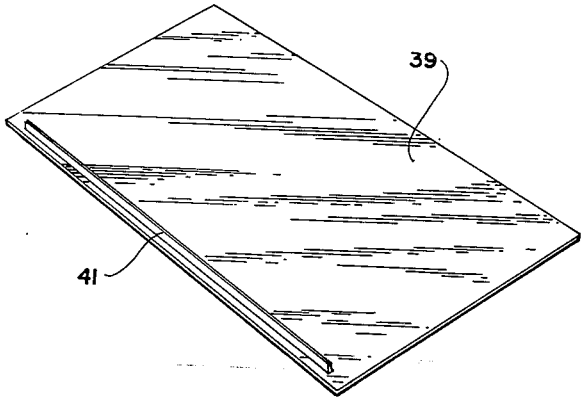
FIG. 5

COLLAPSIBLE READING STAND

BACKGROUND OF THE INVENTION

The present invention relates to a collapsible reading stand.

Collapsible reading stands are described in the following United States patents. U.S. Pat. No. 2,441,932, issued May 18, 1948 to Curry, U.S. Pat. No. 2,563,671, issued Aug. 7, 1951 to Bassinger, U.S. Pat. No. 2,792,668, issued May 21, 1957 to Gallamos, U.S. Pat. No. 3,376,009, issued Apr. 2, 1968 to Domino, U.S. Pat. No. 3,476,348, issued Nov. 4, 1969 to Rustad and U.S. Pat. No. 3,664,629, issued May 23, 1972 to Reed.

Objects of the invention are to provide a collapsible reading stand of simple structure, which is inexpensive in manufacture, collapsible with facility and convenience to a compact form occupying a minimum area, extendable with facility and convenience to a sturdy stand, and functions efficiently, effectively and reliably to support a book at a desired inclination so that a person in bed may read in a position most comfortable to him or her without the need for holding or otherwise supporting the book.

BRIEF DESCRIPTION OF THE DRAWINGS

In order that the invention may be readily carried into effect, it will now be described with reference to the accompanying drawings, wherein:

FIG. 1 is a perspective view of an embodiment of the collapsible reading stand of the invention in extended position, in use;

FIG. 2 is a front view, on an enlarged scale, of the embodiment of FIG. 1, in assembled position;

FIG. 3 is a view, taken along the lines III—III, of FIG. 2;

FIG. 4 is a view of FIG. 2 in collapsed position; and

FIG. 5 is a perspective view of an embodiment of the book-supporting member of the collapsible reading stand of the invention.

DETAILED DESCRIPTION OF THE INVENTION

The collapsible reading stand of the invention comprises first and second upright stick-like support members 1 and 2 in spaced, parallel upright position with an edge 3 and 4, respectively, of each facing an edge of the other. Thus, the edge 3 of the support member 1 faces the edge 4 of the support member 2. The edge 3 has spaced notches 5, 6, 7, and so on, formed therein and the edge 4 has spaced notches 8, 9, 10, and so on, formed therein, as shown in FIGS. 1 and 3.

First and second strut members 11 and 12 are provided (FIGS. 1 and 3). The first strut member 11 has a pair of arms 13 and 14 pivotally affixed to each other at one end of each via a pivot pin 15, as shown in FIGS. 1 and 3, and pivotally affixed to the first support member 1 at the other end of the arm 13 via a pivot pin 16 and pivotally affixed to the second support member 2 at the other end of the arm 14 via a pivot pin 17, as shown in FIGS. 1 and 3.

The second strut member 12 has a pair of arms 18 and 19 pivotally affixed to each other at one end of each via a pivot pin 20, as shown in FIGS. 1 and 3, and pivotally affixed to the first support member 1 at the other end of the arm 18 via a pivot pin 21 and pivotally affixed to the second support member 2 at the other end of the arm 19 via a pivot pin 22, as shown in FIGS. 1 and 3. The first and second strut members 11 and 12 are releasably securable in position from a linearly extending part, as shown in FIGS. 1 and 3.

Third and fourth upright stick-like support members 23 and 24 are provided in spaced, parallel upright position with an edge of each facing an edge of the other, in the same manner as the first and second support members 1 and 2, as shown in FIGS. 1 and 2. The third and fourth support members 23 and 24 are identical to the first and second support members 1 and 2, respectively. Each of the third and fourth support members 23 and 24 has an edge facing an edge of the other, and each of the edges has spaced notches formed therein, in a manner identical to the support members 1 and 2.

Third and fourth strut members 25 and 26 (FIG. 1) are identical to the first and second strut members 11 and 12, respectively. Each of the third and fourth strut members 25 and 26 has a pair of arms pivotally affixed to each other at one end of each, pivotally affixed to the third support member 23 at another end of each of the third and fourth strut members and pivotally affixed to the fourth support member 24 at the other end of each of the third and fourth strut members, in a manner identical to the fastening of the first and second strut members 11 and 12 to the first and second support members 1 and 2. As shown in FIG. 1, the third and fourth strut members 25 and 26 are releasably securable in position forming a linearly extending part.

A fifth strut member 27 (FIGS. 1, 2 and 4) has a pair of arms 28 and 29 pivotally affixed to each other at one end of each via a pivot pin 30, as shown in FIGS. 1 and 2. The arm 28 is pivotally affixed to the first support member at the other end thereof via a pivot pin 31 and the arm 29 is pivotally affixed to the third support member 23 at the other end of said arm via a pivot pin 32, as shown in FIGS. 1 and 2. The fifth strut member 27 is releasably securable in position forming a linearly extending part, in the same manner as the first, second, third and fourth strut members, to position the first and third support members 1 and 23 in spaced, parallel relation.

Sixth and seventh cross strut members 33 and 34 (FIGS. 1, 2 and 4) are pivotally affixed to each other at their centers via a pivot pin 35 (FIGS. 2 and 4). The cross strut members 33 and 34 are pivotally affixed to the second support member 2 at one end 36 and 37, respectively, of each of said cross strut members and are pivotally affixed to the fourth support member 24 at the other end 38 and 39, respectively, of each of said sixth and seventh cross strut members (FIG. 2) to position the second and fourth support members 2 and 24 in spaced parallel relation.

A book-supporting board-like member 39 is positionable in selected grooves of the support members 1 and 2, and 23 and 24, for supporting a book 40 at a desired inclination, as shown in FIG. 1. The book-supporting member 39 preferably has a projecting ledge 41 extending along its lower edge, as shown in FIGS. 1 and 5, to prevent the book 40 from sliding off.

While the invention has been described by means of a specific example and in a specific embodiment, I do not wish to be limited thereto, for obvious modifications will occur to those skilled in the art without departing from the spirit and scope of the invention.

I claim:

1. A collapsible reading stand, comprising first and second upright stick-like support members in spaced, parallel upright position with an edge of each facing an edge of the other, each of said edges having spaced notches formed therein;

first and second strut members each having a pair of arms pivotally affixed to each other at one end of each and pivotally affixed to the first support member at another end of each of the first and second strut members and pivotally affixed to the second support member at the other end of each of the first and second strut members, said first and second strut members being releasably securable in position forming a linearly extending part;

third and fourth upright stick-like support members in spaced, parallel upright position with an edge of each facing an edge of the other, each of said edges having spaced notches formed therein;

third and fourth strut members each having a pair of arms pivotally affixed to each other at one end of each and pivotally affixed to the third support member at another end of each of the third and fourth strut members and pivotally affixed to the fourth support member at the other end of each of the third and fourth strut members, said third and fourth strut members being releasably securable in position forming a linearly extending part;

a fifth strut member having a pair of arms pivotally affixed to each other at one end of each and pivotally affixed to the first support member at another end of the fifth strut member and pivotally affixed to the third support member at the other end of the fifth strut member, said fifth strut member being releasably securable in position forming a linearly extending part to position said first and third support members in spaced, parallel relation;

sixth and seventh cross strut members pivotally affixed to each other at their centers and pivotally affixed to the second support member at one end of each of the sixth and seventh cross strut members and pivotally affixed to the fourth support member at the other end of each of the sixth and seventh cross strut members to position said second and fourth support members in spaced parallel relation; and a book-supporting board-like member positionable in selected grooves of the support members for supporting a book at a desired inclination.

* * * * *